United States Patent [19]

Lane

[11] 4,287,622

[45] Sep. 8, 1981

[54] BED COVER HOLDER AND SERVING TRAY COMBINATION

[76] Inventor: Emma J. Lane, 1430 Ocean Ave., Brooklyn, N.Y. 11230

[21] Appl. No.: 154,299

[22] Filed: May 29, 1980

[51] Int. Cl.[3] ..... A47C 21/02

[52] U.S. Cl. ..... 5/505; 5/508

[58] Field of Search ..... 5/504, 505, 506, 507, 5/508

[56] References Cited

U.S. PATENT DOCUMENTS

| | | | |
|---|---|---|---|
| 1,072,490 | 9/1913 | Oilar | 5/505 |
| 2,112,122 | 3/1938 | Sullivan | 5/505 |
| 2,291,203 | 7/1942 | Bent | 5/505 |
| 3,644,947 | 2/1972 | Padera | 5/507 |

*Primary Examiner*—Alexander Grosz

*Attorney, Agent, or Firm*—Charles J. Speciale

[57] ABSTRACT

A bed cover holder which can also act as a serving tray or support for a tray comprising an openable frame adapted to be removably attached to the sides of the bed. The bed cover holder function acts to keep the pressure of the sheets and blankets off the body of the patient by holding them in a raised position away from the body.

6 Claims, 4 Drawing Figures

BED COVER HOLDER AND SERVING TRAY COMBINATION

BACKGROUND OF THE INVENTION

1. Field of the Invention:

This invention relates to a bed cover holder which can also serve as a serving tray or support therefor.

2. Description of the Prior Art:

At times when a person is very ill or has fractured limbs it can be sheer agony just to bear the weight of the bedcovers. While there are some disclosures of bedcover supports, the disclosure having the most pertinence is that found in U.S. Pat. No. 3,639,929. In said patent there is a disclosure of a U-shaped bed frame which fits under the mattress with the legs of the "U" extending upwardly along the sides of the bed. While, as mentioned, this patent is pertinent, it still does not disclose the present invention which comprises an openable frame adapted to be removably attached to the sides of the bed. In the patent the bedcovers can slide into the open space of the top of the "U" whereas in the present invention this cannot happen.

SUMMARY OF THE INVENTION

It is, therefore, among one of the principal objectives of this invention to provide an improved bedcover holder, particularly for hospital beds, which can also act as a serving tray.

In accord with the present invention there has now been provided a bedcover holder comprising an openable, adjustable wood, metal, or plastic frame adapted to be removably attached to the sides of the bed. The frame also has a reinforced mesh top which allows air through when covered over by the bedcovers and also acts as a serving tray or support for a tray.

BRIEF DESCRIPTION OF THE DRAWING

The invention will be hereinafter more fully described with reference to the accompanying drawing in which.

DESCRIPTION OF THE PREFERRED EMBODIMENTS

Figure 1:
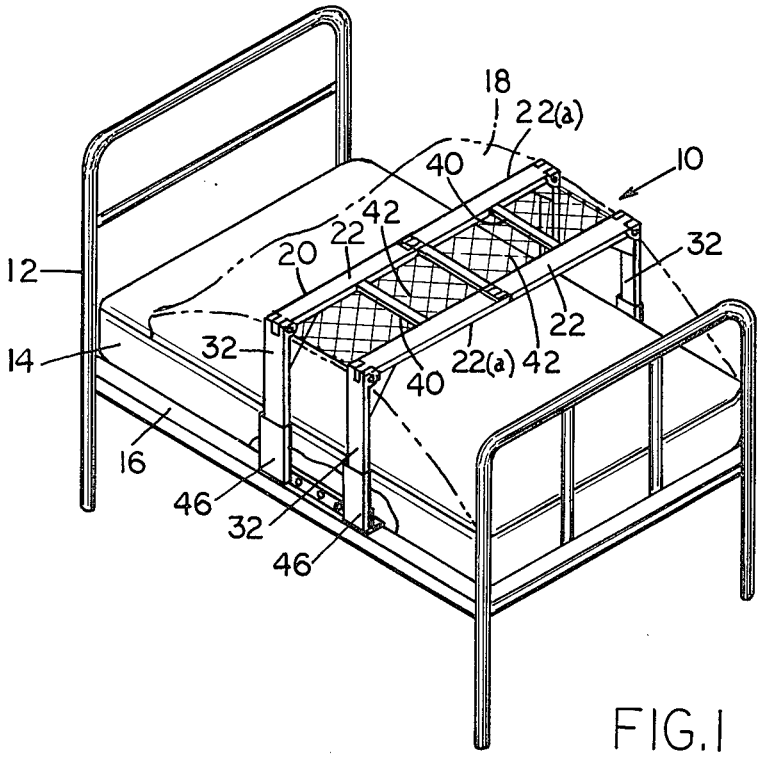
FIG. 1 is a view in perspective of the invention frame in closed position over a bed with the bedcovers shown in phantom.
Figure 4:
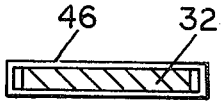
FIG. 4 is a sectional view taken along line 4—4 of FIG. 3.
Figure 2:
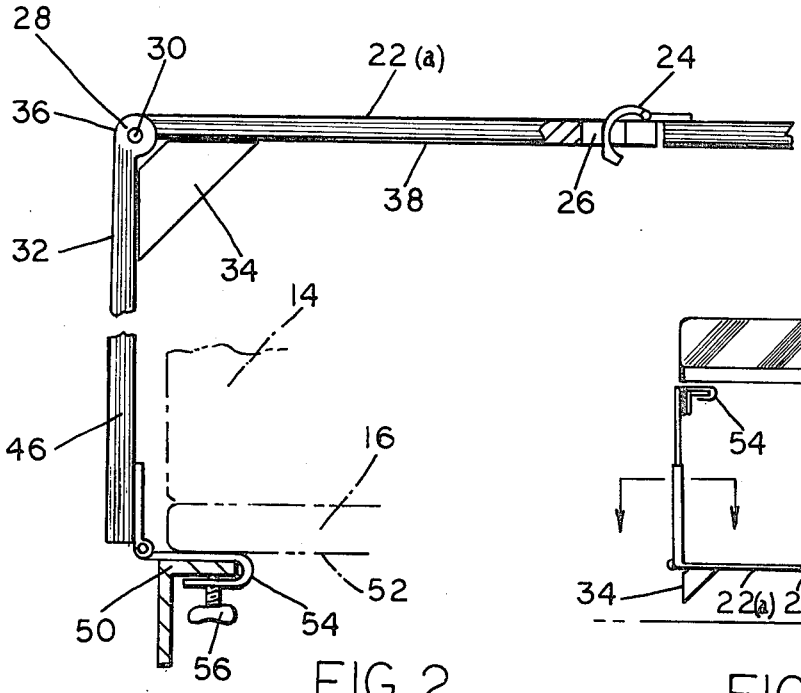
FIG. 2 is an end view, fragmented, of one corner of the frame and the frame top, with the mattress and spring shown in phantom.

Referring now to the figures of the drawing and particularly to FIGS. 1 and 2 there is illustrated therein a perspective view (FIG. 1) of the bedcover holder 10 of the invention in closed fixed position over a bed 12 having a mattress 14 and spring 16. Bedcovers 18 are shown in phantom in the raised position they would occupy when held by the bedcover holder 10. Bedcover holder 10 further comprises a frame 20 having a pair of elongated parallel opposing longitudinal flat top members 22, each top member 22 being further divided in roughly half to form sub-members 22(*a*). Each pair of sub-members 22(*a*) are openably closable by means of an associated pivoting hook 24 and slot 26, in each respective sub-member. Connected by a hinge 28 with hinge pin 30 at each longitudinal end of top members 22 is a vertical flat support member 32, having the same width as its right angled top member counterpart. Truncated triangular stops 34 are provided on the inside of each corner 36 formed by hinged union of top member 22 with vertical support member 32. Stops 34 are pivotally joined to the underside 38 of sub-member 22(*a*) so that they can be pushed back when not needed to support the top members 22 in rigid longitudinal position. Top members 22 are further supported by the provision of a pair of parallel opposing flat struts 40, one each between a pair of opposing sub-members 22(*a*). Still further mesh material (plastic or metal, preferably disposable plastic) 42 is joined between the top members 22. The purpose of the mesh material 42 is to render the top of the frame 20 convertible into a serving tray when not in use as a bedcover support. When it is in use holding up the bedcovers, the spaces in the mesh will allow air penetration onto the patient's body.

Vertical support members 32 in turn are rendered adjustable vertically by inserting them into outer sleeves 46. Sleeves 46 are of a width to allow snug yet slidable fitting of the vertical support members therein. In this way they can be adjusted up or down depending on how high one wishes the frame to be. Sleeves 46 are each in turn secured to the bed frame 50 supporting the underside 52 of spring 16. Securement is made removable by means of a conventional hinge clamp 54 and thumb screw 56. Frame 20 can be of wood, metal, or plastic, while all the fittings may be plastic or metal.

Figure 3:
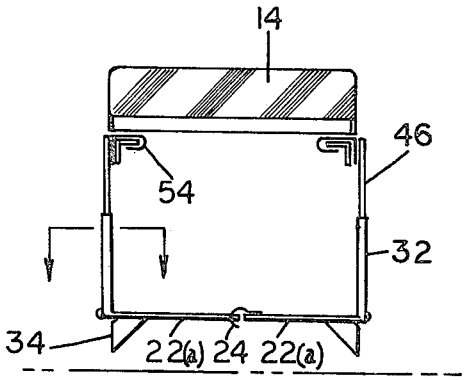
FIG. 3 is an end diagrammatic view of the device in a stored position under a bed.

When not in use the bedcover holder of the invention can be unlatched by removing the hook 24 from slot 26, folding back stops 34, and folding sub-members 22(*a*) flat against vertical support members 32; or the entire structure can be stored under the bed as illustrated in FIG. 3 diagrammatically. Thus, the invention can serve as a bedcover holder, as a tray server when the bedcovers are removed, or even as a tray support when the bedcovers are over the frame.

What is claimed is:

1. Combination bedcover holder and upright serving tray comprising an openable, adjustable frame adapted to be removably attached to the sides of a bed wherein said frame further comprises a pair of elongated, longitudinal, parallel opposing flat top members, each said top member in turn being further divided into substantially equal halves forming a pair of sub-members, each said pair of sub-members being adapted to be openably closeable by means of associated pivoting hook and slot therefor in each respective sub-member, said top members being hingedly connected at each longitudinal end thereof to a vertically extending flat support member having the same width as its top member counterpart, a pivoting truncated triangular stop being provided on the inside of each corner formable by the hinged connection of said top members and vertically extending support members, said stops being pivotally joined along one edge thereof to the underside of its respective sub-member, said stops acting to support said top members, said top members being further supported by the provision of a pair of parallel opposing flat struts, one strut each between each said pair of sub-members.

2. Combination according to claim 1 wherein a mesh material is mounted between said sub-members and said struts.

3. Combination according to claim 2 wherein said mesh material is a plastic.

4. Combination according to claim 2 wherein said mesh material is formed of metal.

5. Combination according to claim 3 wherein said plastic is disposable.

6. Combination according to claim 1 wherein each said vertically extending flat support member is slidingly insertable into an accommodatingly shaped sleeve making said flat support vertically adjustable, each sleeve being hingedly removably secured to said sides of said bed.

* * * * *